United States Patent [19]

Axelrod et al.

[11] 4,395,934

[45] Aug. 2, 1983

[54] WEAR REDUCER

[75] Inventors: Sydney Axelrod, New York, N.Y.; Walter Brenner, Teaneck, N.J.; Barry A. Rugg, New York, N.Y.

[73] Assignee: The United States of America as represented by the Secretary of the Army, Washington, D.C.

[21] Appl. No.: 356,880

[22] Filed: Mar. 10, 1982

Related U.S. Application Data

[62] Division of Ser. No. 142,196, Apr. 21, 1980, Pat. No. 4,334,477.

[51] Int. Cl.[3] ..... F42B 31/02

[52] U.S. Cl. ..... 86/19

[58] Field of Search ..... 86/19; 102/435, 511; 128/284, 285

[56] References Cited

U.S. PATENT DOCUMENTS

| | | | |
|---|---|---|---|
| 12,942 | 5/1855 | Brown | 102/435 |
| 671,708 | 4/1901 | Noble | 102/435 |
| 3,209,689 | 10/1965 | McLennan | 102/435 |
| 3,282,215 | 11/1966 | Roth | 102/435 |
| 3,392,670 | 7/1968 | Picard | 102/435 |
| 3,403,626 | 10/1968 | Jacobson et al. | 102/435 |
| 3,935,099 | 1/1976 | Weaver et al. | 128/85 |
| 4,045,387 | 8/1977 | Fanta et al. | 128/284 |

*Primary Examiner*—Leland A. Sebastian

*Attorney, Agent, or Firm*—Robert P. Gibson; Anthony T. Lane; A. Victor Erkkila

[57] ABSTRACT

An improved ammunition propellant composition and method for reducing gun member wear, erosion, flash and cook-off through use of an additive comprising a mixture of a super water absorbent starch modified polyacrylonitrile which has been subjected to alkaline saponification and water. The wear reducing additive is preferably formed into sheets which can be used with propellants selected from the group consisting of bagged propelling charges and cartridge cased propellants.

5 Claims, 3 Drawing Figures

WEAR REDUCER

DEDICATORY CLAUSE

The invention described herein may be manufactured, licensed, and used by or for the Government for governmental purposes without the payment to us of any royalty thereon.

This application is a division of application Ser. No. 142,196, filed Apr. 21, 1980, now U.S. Pat. No. 4,334,477.

BACKGROUND OF THE INVENTION

This invention relates to a novel chemical additive and method for use in an ammunition propellant system for reducing gun barrel thermal erosion, smoke and flash.

Gun barrel erosion has long been a problem with high flame temperature ammunition propellants and has become more difficult to solve as rates of fire are increased. Extended range requirements mandate the use of larger charges and higher flame temperature propellants. The combination of these conditions results in extreme conditions of gun barrel wear. Theoretically, gun barrel wear can be reduced by protecting the interior surface of the gun barrel against erosive action of the hot propellant gases. It is necessary to use inexpensive chemical additives to reduce gun barrel wear since tremendous quantities of artillery and tank ammunition propelling charges are manufactured for ordnance use.

Various materials have previously been suggested as wear reducing additives. In U.S. Pat. No. 3,148,620, Jacobson et al. disclosed a cartridge with a propellant charge and single projectile having a wear reducing additive comprising a layer of paraffin carrier material disposed around the charges having finely divided titanium dioxide in an amount to produce a temperature resistant barrel "protection" upon firing. Picard teaches that wear and erosion of gun members can be reduced when silicates (U.S. Pat. No. 3,392,669) and inorganic additive consisting of silica dioxide, magnesium oxide or mixtures thereof in the form of natural talc (U.S. Pat. No. 3,392,670) are added, respectively, to propellant systems.

In U.S. Pat. No. 3,362,328, Katz discloses that fibers of polyester, acrylic, silk, wool, glass and asbestos in a wax dispersion containing calcium sulfate, calcium carbonate, a calcium sulfate and titanium dioxide mixture, and a mixture of calcium carbonate and titanium dioxide can be applied to sheets in a propellant system to reduce wear and erosion.

The prior art methods of reducing wear all relate to the use of inorganic active ingredients which are costly, not readily available and which affect propellant performance. The instant invention relates to the use of an inexpensive and readily available organic material, i.e., a starch modified copolymer which has the ability to absorb many times its own weight in water with or without glycol, to reduce wear of gun members coming into contact with hot gases generated by propellant ignition.

SUMMARY OF THE INVENTION

The invention relates to an improved propellant system and method having a propellant charge and an additive for reducing gun member erosion and wear wherein the additive comprises a mixture of a starch-acrylonitrile copolymer which has been subjected to alkaline saponification to allow for absorption of large amounts of water. Upon propellant ignition, the additive mixture produces a laminar coolant layer on the surfaces of the gun members to thereby protect the members against wear while reducing smoke and muzzle flash.

It is a principal object of this invention to provide an economical chemical additive for use in propellant systems which will reduce wear and erosion in weapon members subjected to hot gases formed by propellant ignition.

It is another object of this invention to provide a method for reducing gun member erosion and wear through use of an additive comprising water and a starch-acrylonitrile copolymer which has been subjected to alkaline saponification to allow absorption of large amounts of water while maintaining geometric integrity.

It is a further object of this invention to provide bagged propelling charges and cartridges having economical and readily available chemical additives which produce a laminar cooling layer on the surface of gun members to protect them against wear upon ignition of the propellant.

It is a still further object of this invention to provide a propellant system having a wear reducing additive comprising sheets of a super water absorbent starch-acrylonitrile copolymer and water, which can be handled and assembled with a bagged propelling charge or within a cartridge case.

These and other objects of the invention will become apparent from the following detailed description of the invention.

Figure 1:
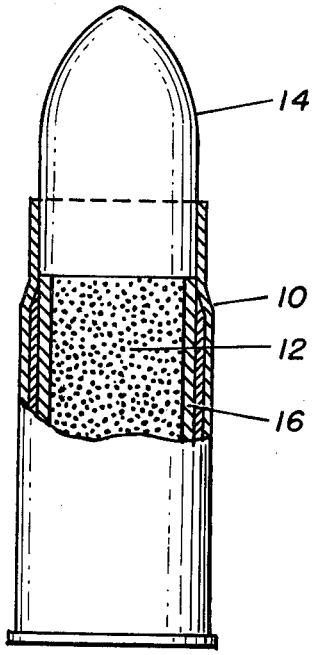
FIG. 1 is a front elevation view, partly broken away, of a cartridge embodying an additive of the present invention.
Figure 2:
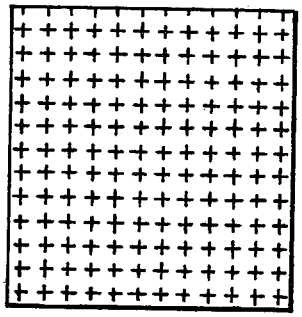
FIG. 2 is a view of the unfolded sheet utilized in the cartridge of FIG. 1.

The cartridge case shown in FIG. 1 is one embodiment of the invention having a metal case 10, a propellant charge 12 comprised of a suitable propellant selected for the particular ammunition, and a projectile 14. Within the case 10 and in close contact with the inner surface thereof is an envelope of plastic film 16, e.g., polyethylene, which acts as a moisture barrier and contains a sheet of the "super-slurper" starch-modified pplyacrylonitrile copolymer of this invention containing an absorbed water and glycol mixture.

Figure 3:
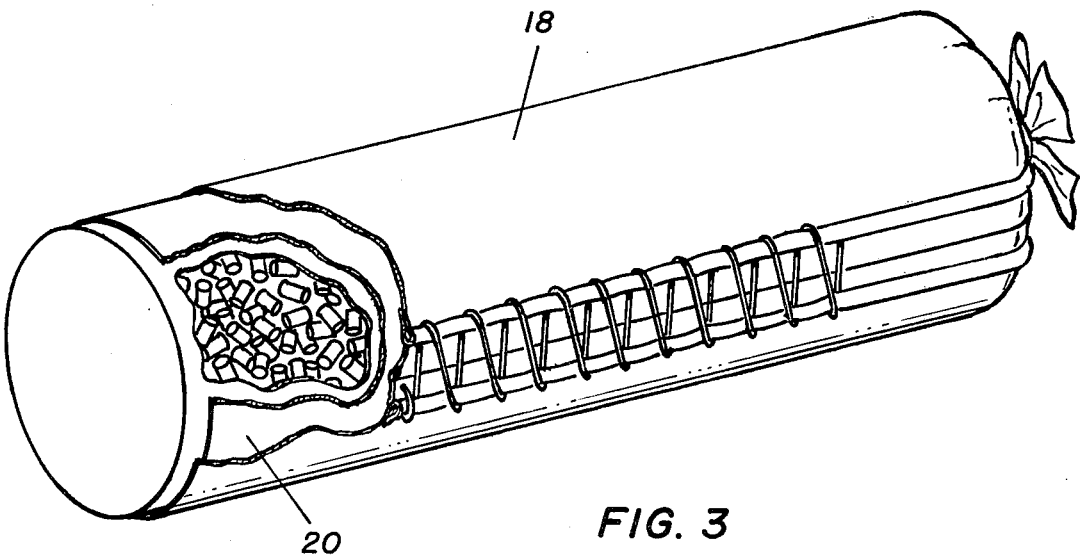
FIG. 3 is a side view of a bagged propelling charge of separate loaded ammunition with the additive sheet.

FIG. 3 is a simplified representation of a conventional bagged propellant charge illustrating another embodiment of the invention. A polyethylene film envelope 20 containing a sheet of the "super-slurper" of this invention, which has absorbed thereon a water-glycol mixture, is placed around the conventional propellant charge, not shown, and within the propellant charge lacing jacket 18. The specific propellant charge components used are not critical to the invention and are, therefore, not shown in detail. In operation, the super-slurper sheets are simply placed within the lacking jacket, thus eliminating the costly and time-consuming prior art practice of sewing sheets of inorganic additive to the inside surface of the lacing jacket.

DESCRIPTION OF THE INVENTION

The present invention is based upon the discovery that by absorbing large amounts of water in starch-acrylonitrile copolymers, which have been subjected to alkaline saponification, as an additive a laminar coolant layer is produced on the gum member surfaces to be protected against wear. The additive has been found to be most efficient in greatly reducing gun barrel wear, smoke and flash upon ignition of the propellant.

The starch-acrylonitrile copolymers used in the propellant and method of this invention are prepared in accordance with the method disclosed in the U.S. Pat. No. 3,935,099 to Weaver et al. and U.S. Pat. No. 4,045,387 to Fanta et al. in which the method of making the copolymer a super-absorber of water, i.e., a "super-slurper" is disclosed.

The ability of the super-slurpers to absorb large amounts of water and maintain their geometric integrity allows sheets of super-slurper to be produced containing 10% or less of copolymer and 90% or more of water or water with ethylene glycol, to prevent freezing of water at low temperatures. These sheets can be handled and assembled with either a cartridge case or a bagged propelling charge.

The super-slurpers are inexpensive and readily obtainable materials which, when allowed to absorb up to 900 times their weight in water, or a water and glycol mixture, and then placed within a cartridge case, propellant container or propellant bagged charge, will reduce gun barrel erosion to a remarkably large degree upon ammunition firing. The glycol in the water-glycol mixture serves as an antifreeze and enhances the anti-erosion effect of the water.

The problems of flash suppression, cook off and erosion have previously been attacked by attempts to reduce the temperature in the firing cycle of all ordnance applications. Water by virtue of its low cost, general availability and uniquely high heat capacity, and heat of vaporization is a very attractive coolant, particularly in view of its non-toxic nature and its thermal stability up to very high temperatures. Previous attempts to use water as a flash suppressant by injection into the combustion gases of propellants have been theoretically successful, but clearly impractical from an operational point of view. The super-slurpers have been found to hold and retain large quantities of water, especially for high temperature short-time thermal environments, in the form of an essentially "solid water" which does not evaporate. When exposed to high temperatures, the high heat of vaporization of the water is available to absorb substantial amounts of heat, thus creating the desired cooling effect. The vaporization temperature of water is sufficiently low (100° C.) to prevent cook off of ammunition rounds. As an additional feature, the super absorbers can be made in various physical forms, such as sheets and film, fiber and powders, while retaining their physical forms after water absorption.

The following examples are meant to be illustrative of the novel propellant additive and method of this invention and are not intended to be limiting upon the scope of the invention.

EXAMPLE 1

10 ounces (283.5 gr.) of starch modified polyacrylonitrile in sheet form prepared as described in U.S. Pat. Nos. 4,045,387 and 3,935,099, were treated with water by spraying the polymer until 10 oz. (283.5 gr.) water were absorbed. The water-containing sheet was put in the extended configuration into a polyethylene envelope. The polyethylene was heat-sealed on all four sides.

EXAMPLE 2

Five ounces (141.75 gr.) of starch-modified polyacrylonitrile prepared as described in patents (Example 1) were treated with water by spraying a sheet of super-slurper until 15 oz. (425.25 gr.) of water were absorbed. The water containing sheet was placed in the extended form in a polyethylene envelope which was heat-sealed on all four sides.

EXAMPLE 3

Two ounces (56.7 gr.) of super-slurper prepared as described above were treated with a water/glycol mixture (80:20 ratio) by spraying a sheet of super-slurper until 18 oz. (510.3 gr.) of the mixture were absorbed. The wet sheet was placed in the extended form in a polyethylene envelope which was heat-sealed on all four sides.

EXAMPLE 4

Four ounces (113.4 gr.) of super-slurper were treated with 26 oz. (737.1 gr.) of water by spraying a sheet of super-slurper with water until all the water was absorbed. The wet sheet was placed in the extended form in an envelope of polyvinylidene-chloride film which was heat-sealed on all four sides.

The sheets prepared according to the above examples in envelopes are ready for use in cartridge cases or in separate loaded propelling charges. The weight of the super-slurper and water or water/glycol mixture is adjusted for the caliber of the ammunition.

In testing the effectiveness of our inexpensive and readily available additives, Zone 8 bagged charges for the 155 mm Howitzer were prepared with sheets of super-slurper in a polyethylene envelope, as shown, for example, in FIG. 3. This charge, known by the military designation M203, was fired in the gun, both with and without super-slurper sheets. The test data results show that a standard M203 charge which includes a $TiO_2$/wax additive caused wear of 11 microinches ($2.79\times10^{-4}$ mm) after five shots, while the M203 incorporating the super-slurper caused wear of only 3 microinches ($0.127\times10^{-4}$ mm) after five shots.

A summary of test data for M203 propelling charge (Zone 8) in M199 gun tube of a standard M198 Howitzer containing the super-slurper containing liner of this invention, as compared to other conventional liners is shown in the table below.

M203 Propelling Charge (Zone 8) in M199 Gun Tube, Reporting Average of Five Shots Fired

| Liner | Pressure (psi) | Velocity (fps) | Wear-Fixed Sensor (microinches) |
|---|---|---|---|
| Standard (17.5 oz. $TiO_2$/wax) (.482 kg.) | 44,000 (3,093.2 kg/cm$^2$) | 2683 (818 m/sec) | 2 (.0847 $\times 10^{-4}$ mm) |
| Super-slurper 19.5 oz. - 80/20 water/glycol and slurper total wt. (.539 kg.) | 45,600 (3,205.7 kg/cm$^2$) | 2715 (828 m/sec) | nil |
| 17.5 oz. Talc/wax (.482 kg.) | 44,000 (3,093.2 kg/cm$^2$) | 2672 (814 m/sec) | 3 (0.127 $\times 10^{-4}$ mm) |
| No liner | | | leading edge of |

-continued

| M203 Propelling Charge (Zone 8) in M199 Gun Tube, Reporting Average of Five Shots Fired | | | |
|---|---|---|---|
| Liner | Pressure (psi) | Velocity (fps) | Wear-Fixed Sensor (microinches) |
| | | | sensor melted |

The liner sheets prepared from super-slurpers in envelopes in accordance with this invention can readily be used in cartridge cases or in separate loaded propelling charges. Thus artillery ammunition of the fixed, semi-fixed, separated or separate-loading types may be used with the super-slurper of the invention.

The ratio of super-slurper to water or super-slurper to water/glycol mixture can be varied within the skill of one in the art depending upon the weight of propellant charge used which is, in turn, determined by the caliber of ammunition and the required ballistic performance. In practice, as shown by the examples above for the conventional propellant charges, the ratio of copolymer to water may be varied within the range of from 1:1 to 1:9. The sheets of this super-slurper can be made of various thickness, as desired, though a thickness of less than 0.005 in. (0.127 mm) thickness is preferred for optimum wear reduction.

The super water absorbers of this invention are stable during long time storage at temperatures from −65° F. to 165° F. (−53.8° to 73.9° C.) and relative humidities from 20% to 100% without changing water content or deteriorating chemically, particularly in proximity to nitroglycerin containing propellants.

The propellant composition, ammunition and the method of preparing the liner for use in the bagged propellant charge or cartridge case of this invention are conventional in the art and are not considered a critical part of this invention. Thus, the novel propellant additive of this invention can be used with any ammunition propellant to reduce wear and erosion in gun members.

The invention has succeeded in providing an additive for use in propellant systems wherein gun members coming into contact with hot gases produced by ignition of the propellant are protected against wear and erosion by the formation of cooler layers of gas adjacent to the gun member. The additives are inexpensive, readily prepared through commercially known processes and, most importantly, do not adversely affect ballistic performance of weapons employing the ammunition additive.

Applicants having disclosed their invention, obvious modifications will become apparent to those skilled in the munitions art. Applicants therefore desire to be limited only by the scope of the appended claims.

We claim:

1. A method for reducing gun member thermal erosion and wear through use of coolant additive with a propellant charge for reducing propellant flame temperature comprising the steps of preparing a sheet comprising a highly water adsorbent starch-acrylonitrile copolymer which has been subjected to alkaline saponification and a major amount of absorbed water; and disposing said sheet around the ammunition propellant charge to reduce erosion by formation of a laminar cooling layer of gas adjacent to the gun member upon firing of said charge.

2. The method of claim 1 wherein the water absorbed within said sheet contains ethylene glycol antifreeze to prevent freezing of the water at low temperature.

3. The method of claim 1 wherein the coolant additive sheet is disposed around said propellant charge within a conventional cartridge case.

4. The method of claim 1 wherein the coolant additive sheet is disposed around said propellant charge within a propellant bagged charge.

5. The method of claim 1 wherein the additive sheet consists essentially of no more than 10% by weight copolymer and the balance absorbed water.

* * * * *